United States Patent [19]

Schmitt-Thomas et al.

[11] 4,118,256

[45] Oct. 3, 1978

[54] PROCESS FOR THE PRODUCTION OF OXYGEN-FREE COPPER CASTING AND MOLDINGS

[75] Inventors: Karlheinz G. Schmitt-Thomas, Ismaning; Alfred Lipp, Bad Wörishofen, both of Fed. Rep. of Germany; Karl Schwetz, Sulzberg, Austria

[73] Assignee: Electroschmelzwerk Kempten GmbH, Munich, Fed. Rep. of Germany

[21] Appl. No.: 738,819

[22] Filed: Nov. 4, 1976

[30] Foreign Application Priority Data

May 11, 1976 [DE] Fed. Rep. of Germany ..... 2620831

[51] Int. Cl.[2] ..... C22F 1/08

[52] U.S. Cl. ..... 148/160; 75/76; 75/135; 75/153; 148/13.2

[58] Field of Search ..... 148/23, 12.7, 13.2, 148/160; 164/259; 75/159, 76, 135, 153, 13.2, 160

[56] References Cited

U.S. PATENT DOCUMENTS

| | | | |
|---|---|---|---|
| 2,281,691 | 5/1942 | Hensel et al. | 75/153 |
| 2,380,566 | 7/1945 | Wyllie | 75/153 |
| 2,479,311 | 8/1949 | Christensen | 75/153 |
| 3,595,705 | 7/1971 | Bray | 75/153 |

OTHER PUBLICATIONS

Neu, M. et al., *Fluxing and Deoxidation . . . for Copper;* in *Trans. Amer. Found. Soc.,* Aug. 1956, pp. 616–624.

Newton, J. et al., *Metallurgy of Copper,* New York, 1942, p. 222.

*Primary Examiner*—M. J. Andrews

*Attorney, Agent, or Firm*—Allison C. Collard; Thomas M. Galgano

[57] ABSTRACT

A process for the production of oxygen free copper castings and moldings, which contain 0.05 to 0.2% by weight of boron as micro-alloy element, by deoxidation of oxygen containing copper melts by means of calcium hexaboride, comprising introducing 0.3–1% by weight of a $CaB_6$ into the copper melt, the $CaB_6$ containing at least 3% C calculated on the weight of the $CaB_6$, subsequently subjecting the cooled melt, if desired while molding the same, to a solution annealing operation and following up with a storage for an extended time.

5 Claims, No Drawings

PROCESS FOR THE PRODUCTION OF OXYGEN-FREE COPPER CASTING AND MOLDINGS

The invention relates to the production of oxygen free copper castings and moldings.

In the use of commercial copper for purposes of electrical engineering, the quality of the copper is rated by its mechanical characteristics, such as moldability, ductility, capability of being soldered, as well as its conductivity. Satisfactory mechanical properties which are dependent, among other things, on lack of porosity, can only be obtained when the oxygen content of the copper is as low as possible.

For that reason, it has long been customary to subject copper melts to a deoxidation treatment, the usual deoxidation agents for technical purposes being principally phosphorus and lithium, as well as calcium, which agents effect a sufficient deoxidation. However, due to the fact that there will always remain some residual content of these substances in the copper, partly dissolved therein or forming compounds therewith, the properties of the copper will be affected, so that the use of the additives is limited.

Thus, while for example, the addition of phosphorus as deoxidant, will improve the mechanical characteristics of copper, especially its conductivity. On the other hand, lithium and calcium hexaboride, when added in sufficient amounts for deoxidation, will not negatively affect the conductivity of copper, but they will not improve the mechanical characteristics. The use of lithium has technical difficulties and is, moreover, expensive, and therefore it was necessary to increase the quantities of calcium hexaboride for achieving the same deoxidation effect; its use was, consequently, combined with phosphorus in the so-called "duplex-process". This process, however, is very expensive on a technical scale and has to be carried out in two separate deoxidation operations. See M. G. Neu and J. E. Gotheridge, "AFS Transaction of the American Foundrymen's Society," vol. 64, ps 616–624 (1956). In that publication it is, moreover, shown that the use of 0.49% $CaB_6$ referring to the weight of the copper melt, leaves a residue of boron in the copper treated amounting to 0.0120% (see table 3, page 619) from which the author deducts that this low amount of deoxidant remaining in the melt makes the use of $CaB_6$ possible in amounts sufficient for deoxidation without negative influence on the electrical properties.

On the other hand, it was also known that by alloying boron with copper the strength of the latter could be increased. But there, too, older tests (see F. Lihl and O. Fleischl, "Metall" vol. 8, p. 17, 1954) proved a strong decrease of the conductivity with increasing boron content. These results were, however, evidently influenced by an additional content of foreign matter, e.g. iron, (see K. Dies, "Kupfer und Kupferlegierungen in der Technik" Springer-Verlag 1967, chapter 7.1.3, p. 407) which was introduced as impurity in the process of production, where borax was used as boron provider.

To avoid the above-mentioned disadvantages, attempts have been made to alloy crystalline boron or amorphous boron powder with copper (see J. Rexer and G. Petzow, "Metall", vol. 24 [1970] p. 1083. However, these processes are very expensive, furthermore, high copper losses through evaporation have to be faced due to the poor wettability of the boron.

It is the object of the present invention to provide a technically simple and inexpensive process for making oxygen free copper moldings and castings, which permits one to deoxidize copper melts in a single operation and to alloy them with boron, so that an improvement in the mechanical properties of copper is achieved without a loss of conductivity.

According to the invention, oxygen free copper castings and moldings are made which contain 0.05 to 0.2% by weight of boron as micro-alloy element, by deoxidation of oxygen-containing copper melts by means of $CaB_6$, wherein 0.3–1% by weight of $CaB_6$ is introduced into the copper melt, the $CaB_6$ containing at least 3% C calculated on the weight of the $CaB_6$, whereafter the melt is cooled, if desired while being molded, and subjected to a solution heat treated, followed by storage for an extended time.

In carrying out the process according to the invention the C-content of the $CaB_6$ in at least the minimal amount mentioned is of prime significance. A content of 8–12.5% calculated on the weight of the $CaB_6$ has proved to be especially advantageous. The C-content insures that the $CaB_6$ will not only act as deoxidant, but will also deliver boron up to a content of at least 0.15% by weight.

The process according to the invention is preferably carried out by melting down the oxygen-containing copper, e.g. cathode copper with an $O_2$ content of 0.01–0.03% by weight in a graphite crucible which has been placed in a vacuum induction furnace, whereupon the C-containing $CaB_6$ is introduced under a protective gas atmosphere, e.g. argon, by means of a graphite diving bell. The protective gas atmosphere may be dispensed with, if the surface of the melt is instead covered with pine soot. The two means, protective gas atmosphere and pine soot covering may also be used in combination.

After deoxidation is terminated, the charges are poured into graphite molds, if desired under protective gas, and chilled, the chilling being delayed by the use of molds, preheated to 300° C to 600° C, this delay being optional. The chilling may also be effected while molding is performed in a known manner, or it may be combined with a subsequent cold-molding. Subsequently, the obtained castings or moldings are solution heat treated and stored for an extended time. It is particularly advantageous to perform the heat treatment for 30 to 600 minutes by heating to 800° C to 950° C and to store for 60 to 300 hours at temperatures between 200° C and 500° C.

The copper castings or moldings made according to the invention show a residual oxygen content of about 10 ppm, electric conductivity above 50 $m/mm^2\,\Omega$, hardness of 45 to 55 HV 10 after extended storage and tensile strength over 400 $N/mm^2$. The analysis of the deoxidized copper shows that calcium has been withdrawn with the slag, boron however remains in the copper in solid solution in the amount stated. The metallographic polished section displays a dense, practically pore-free structure.

By our own experiments we were able to prove, that phosphorus or lithium used as deoxidant cause under comparable conditions already at residual quantities of 0.01% by weight a considerable decrease in the conductivity of copper, which is due in the charges treated with phosphorus to resistance increase because of mixed crystal formation, and is explained with the use of lithium, which is insoluble in copper, by the formation of lithium hydride.

When the charges were treated according to the invention with $CaB_6$ containing C, the alloying of boron with copper in the amounts described, did not lead to a decrease of the conductivity below 50 m/mm² Ω so that the known strength increasing properties of copper-boron alloys, which are otherwise not accessible without difficulties, could be utilized simultaneously with the effective deoxidation.

In the following examples, the specimens for determination of the $O_2$ content were taken before deoxidation with a quartz pipette. After deoxidation, the $O_2$ content was measured in a specimen taken from the block. The measurement of the electric conductivity and the tensile strength were carried out on cold-drawn wires of 1 mm thickness. The hardness was determined according to Vickers as HV 10/10.

EXAMPLE 1

As starting material plate-shaped cathode or electrolytic copper was used, which was remelted in air for 7 minutes. 400 g of this melt having an $O_2$ content of 0.01–0.03% by weight, were melted down in a graphite crucible which was placed in a vacuum induction furnace. Then 0.5% $CaB_6$, calculated on the weight of the melt, with a C content of 12.33% calculated on the weight of the $CaB_6$, were added in the form of a powder at a temperature of 1,150° C in a protective argon atmosphere. The powder had a mean grain size of about 300 μm which was covered by a copper foil of 0.1 mm thickness and submerged by means of a diving bell beneath the surface of the melt, where it was moved for 4 minutes. Subsequently, the deoxidized melt was poured into a graphite mold heated to 300° C and likewise covered by a protective argon atmosphere. The cast block obtained had a B content of 0.2% by weight (determined by emission spectrography) and 9 ppm $O_2$.

From the casting block a specimen, 20×10×5, was sawn off and was subjected to heat treatment (solution annealing) at 880° C for 240 minutes. After having been chilled in ice water, the specimen was treated with polishing paper having a grain size of 600 and macro-hardness was determined according to Vickers (Din 50 133) at a load of 10 kp, for a period of 10 seconds (HV 10/10). The indicated hardness value is a mean value of 3 impressions. The specimen was then polished once more, until the impressions disappeared and was stored for 300 hours at 400° C. After chilling in ice water, the determination of the macro-hardness was repeated.

To determine the tensile strength and electric conductivity, a cold-drawn wire was made from the casting with a diameter of 1 mm. The tensile strength was determined according to DIN regulation 52.210. The measured value is the arithmetic mean of 3 tests. The electric conductivity was measured with a conventional device at a testing temperature of 20° C. The data found are listed in Table 1 below.

EXAMPLE 2

A copper melt was deoxidized by the process described in example 1, with the difference that 0.3% $CaB_6$ calculated on the total weight of the melt were used, containing 8% C calculated on the weight of the $CaB_6$. The obtained casting had a B content of 0.158% by weight and 10 ppm $O_2$.

The solution-heating process was carried out for 30 minutes at 900° C. The values found for macro-hardness, tensile strength, and conductivity are listed in Table 1.

EXAMPLE 3

Plate-shaped cathode copper was re-melted in air with addition of 1% by weight of copper(I)oxide and copper(II)oxide for 7 minutes at 1,150° C in order to reach a sufficiently high oxygen absorption by the bath. 650 g of this melt having an $O_2$-content of 0.03 to 0.17% by weight were melted down in a graphite crucible and covered with a 30 mm layer of pine soot. Then, 1% $CaB_6$ calculated on the total weight of the melt, with a C-content of 3.84%, calculated on the weight of the $CaB_6$, were introduced into the melt by means of a diving bell as described in example 1. Thereafter, the deoxidized melt was poured into an unheated graphite mold. The casting obtained had a B content of 0.094% by weight and 15 ppm $O_2$. The solution heat treatment was carried out for 30 minutes at 850° C. Storage lasted for 600 hours at 400° C. The data for macro-hardness, tensile strength and conductivity are listed in table 1.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and intended to be, within the full range of equivalence of the following claims.

TABLE 1

| Procedure of | Nr. of Examples | | |
|---|---|---|---|
| | 1 | 2 | 3 |
| Melting with | Protective Gas | Protective Gas | Pine Soot |
| $CaB_6$ addition [%] | 0.5 | 0.3 | 1 |
| C-content of the $CaB_6$ [%] | 12.33 | 8 | 3.84 |
| O-content after the Deoxidation in [ppm] | 9 | 10 | 15 |
| Boron content of the copper [%] | 0.2 | 0.158 | 0.094 |
| Solution heat treatment temperature [° C] | 880 | 900 | 850 |
| Heat treatment time [min] | 240 | 30 | 30 |
| Hardness after heat treatment [HV/10] | 45 | 40 | 41 |
| Storage temperature [° C] | 400 | 400 | 400 |
| Storage time [min] | 18000 | 18000 | 36000 |
| Hardness after storage [HV/10] | 55 | 51 | 45 |
| Increase in hardness [%] | 22 | 27 | 9 |
| Tensile strength [N/mm²] | 445 | 421 | 407 |
| Conductivity [m/Ωmm²] | 53.19 | 52.91 | 56.49 |

What is claimed is:

1. A process for the production of oxygen-free copper castings and moldings, which contain 0.05 to 0.2% by weight of boron as a micro-alloy element, the steps consisting essentially of:

melting oxygen-containing electrolytic copper in a crucible to produce a melt;

covering the exposed surface of the melt with a protective layer;

immersing an additive consisting essentially of 0.3–1% of a $CaB_6$, calculated on the weight of said melt, and between 3 and 12.5% of carbon, calculated on the weight of said $CaB_6$, in said melt, said additive being in the form of a powder having a mean grain size of 300 μm, said step resulting in the production of an oxygen-free, copper-boron binary alloy, which contains 0.5 to 0.2% by weight of boron as the micro-alloy element;

cooling the melt;

molding the cooled melt to yield a solid casting;

solution annealing the casting for a time between about 30 to 600 minutes at a temperature in the range of about 800° C to 950° C; and aging the quenched annealed casting for an extended time between about 60 to 300 hours at a temperature in the range of about 200° C to 500° C.

2. The process according to claim 1 wherein said protective layer is a protective gas atmosphere.

3. The process according to claim 1 wherein said protective layer is pine soot.

4. The process according to claim 1 additionally including the step of quenching the casting following said solution annealing and aging steps.

5. The process according to claim 1 wherein said $CaB_6$ has a carbon content of 8 to 12.5% calculated on the weight of said $CaB_6$.

* * * * *